US009279275B2

(12) United States Patent
Nam

(10) Patent No.: US 9,279,275 B2
(45) Date of Patent: Mar. 8, 2016

(54) OUTSIDE HANDLE FOR VEHICLE

(71) Applicants: Hyundai Motor Company, Seoul (KR); Kia Motors Corporation, Seoul (KR)

(72) Inventor: Jin Woo Nam, Seoul (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 173 days.

(21) Appl. No.: 14/102,992

(22) Filed: Dec. 11, 2013

(65) Prior Publication Data

US 2015/0054295 A1 Feb. 26, 2015

(30) Foreign Application Priority Data

Aug. 21, 2013 (KR) ..... 10-2013-0098829

(51) Int. Cl.
*E05B 3/00* (2006.01)
*E05B 77/06* (2014.01)

(52) U.S. Cl.
CPC ..... *E05B 77/06* (2013.01); *Y10T 292/57* (2015.04)

(58) Field of Classification Search
USPC ..... 292/336.3, DIG. 22
See application file for complete search history.

(56) References Cited

U.S. PATENT DOCUMENTS

| | | | | |
|---|---|---|---|---|
| 3,799,596 | A * | 3/1974 | Nozomu et al. | 292/216 |
| 9,033,396 | B2 * | 5/2015 | Nam | 296/146.6 |
| 2008/0036219 | A1 * | 2/2008 | Savant et al. | 292/336.3 |
| 2009/0102206 | A1 * | 4/2009 | Lee | 292/336.3 |

FOREIGN PATENT DOCUMENTS

| | | | |
|---|---|---|---|
| JP | 2011-106265 | A | 6/2011 |
| KR | 10-0747227 | B1 | 8/2007 |
| KR | 10-0783544 | B1 | 12/2007 |
| KR | 10-2011-0032508 | A | 3/2011 |
| KR | 10-2011-0135548 | A | 12/2011 |

* cited by examiner

*Primary Examiner* — Mark Williams
(74) *Attorney, Agent, or Firm* — Morgan, Lewis & Bockius LLP

(57) ABSTRACT

An outside handle apparatus for a vehicle may include a handle grip including a first locking part, a handle base, a handle lever having a second locking part and rotatably supported by an axis of the handle lever at one side of the handle base and moving in linkage with the handle grip while the second locking part formed at an lower end of the handle lever is locked with the first locking part of the handle grip, and an interference lever pivotally coupled to the handle base at one side of the handle base, wherein the interference lever rotates in linkage with a rotation of the handle lever at ordinary times, and is interlocked with the handle lever due to a rotation of the handle lever upon crash to control the rotation of the handle lever.

5 Claims, 11 Drawing Sheets

OUTSIDE HANDLE FOR VEHICLE

CROSS-REFERENCE TO RELATED APPLICATION

The present application claims priority to Korean Patent Application No. 10-2013-0098829 filed Aug. 21, 2013, the entire contents of which is incorporated herein for all purposes by this reference.

BACKGROUND OF THE INVENTION

1. Field of the Invention

The present invention relates to an outside handle for a vehicle. More particularly, the present invention relates to an outside handle for a vehicle, which is equipped with a handle interference structure that prevents a door from being opened by an inertial force upon side crash of a vehicle.

2. Description of Related Art

Generally, an outside handle serves as an interface for a user to open and close the door of a vehicle from the outside of the vehicle. The outside handle includes an assembly of an outside handle grip and an outside handle base, and is installed at the outer side and the inner side of a door outer panel.

That is, the outside handle basically includes a handle grip that is exposed to the outside of the door outer panel to be actually manipulated by a user, and a handle base that is located inside the door outer panel so that the handle grip can be pulled from the handle base.

On the other hand, upon side crash of a vehicle, the vehicle is affected by an inertial force, which allows the door to open because the outside handle is pulled.

Accordingly, a balance weight is disposed in a vehicle to offset the inertial force of the outside handle. The balance weight prevents the door from being opened by the inertial force acting on the balance weight.

For example, as shown in FIGS. 4 and 5, the outside handle includes a handle grip 100 and a handle base. A balance weight 120 is provided at one side of the handle base. Also, a handle lever 130 is rotatably provided so as to operate in linkage with the handle grip 100.

Here, the handle lever 130 formed integrally with the balance weight 120 is connected to the handle grip using a lockable structure. At ordinary times, the handle lever rotates together. However, when a forward inertial force is generated upon side crash of a vehicle, the balance weight 120 prevents the door from being opened.

In this outside handle structure, the handle grip 100 is pulled by a force directing to the outside of a vehicle, i.e., inertial force of a vehicle immediately after the side-crash.

When the handle grip 100 is pulled, a latch connected to the handle grip 100 is released to open the door.

In order to prevent this, the balance weight 120 is mounted on the handle lever 130 to offset the inertial force.

However, the balance weight needs to have the equivalent weight to the handle grip to compensate for the inertial force of the handle grip, and thus limitations such as weight increase, opening by the counter inertial force, and deficiency of layout are incurred.

In consideration of these limitations, convention arts disclose outside handles with various types of door opening preventing devices, which can replace the balance weight.

However, typical door opening preventing devices have limitations in terms of structure and layout deficiency. Also, since the typical door opening preventing devices operate through many linkage steps, they have structural and functional limitations such as a difficulty in securing the reliability of operation.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing an outside handle for a vehicle, which can secure the structural simplification and the functionality and effectively prevent a door from being opened upon side crash of a vehicle, by implementing a new type of door opening preventing device that can prevent the door from being opening using a combination a handle lever and an interference lever that control the pulling of the handle lever through an interlocking action upon side crash of a vehicle.

In an aspect of the present invention, an outside handle apparatus for a vehicle, may include a handle grip including a first locking part, a handle base, a handle lever having a second locking part and rotatably supported by an axis of the handle lever at one side of the handle base and moving in linkage with the handle grip while the second locking part formed at an lower end of the handle lever is locked with the first locking part of the handle grip, and an interference lever pivotally coupled to the handle base at one side of the handle base, wherein the interference lever rotates in linkage with a rotation of the handle lever at ordinary times, and is interlocked with the handle lever due to a rotation of the handle lever upon crash to control the rotation of the handle lever.

The outside handle apparatus may further may include a connection spring fixed to the handle lever and locked and supported by the interference lever at one end portion of the connection spring, wherein the handle lever and the interference lever move in linkage with each other by the connection spring.

The handle lever may include a first interference part with a flat surface at an upper end portion of the handle lever, wherein the interference lever may include a second interference part with a flat surface at a lower end portion of the interference lever, and wherein the rotation of the handle lever is configured to be controlled by an interlocking interference between the first and second interference parts during the rotation of the handle lever upon the crash.

The handle lever may include a first return spring that may have one end portion fixed to the handle base and the other end portion fixed to the handle lever to provide a restoring force to the handle lever.

The interference lever may include a second return spring that may have one end portion fixed to the handle base and the other end portion fixed to the interference lever to provide a restoring force to the interference lever.

The return spring is configured to bias the first interference part of the interference lever toward the second interference part of the handle lever.

Other aspects and exemplary embodiments of the invention are discussed infra.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
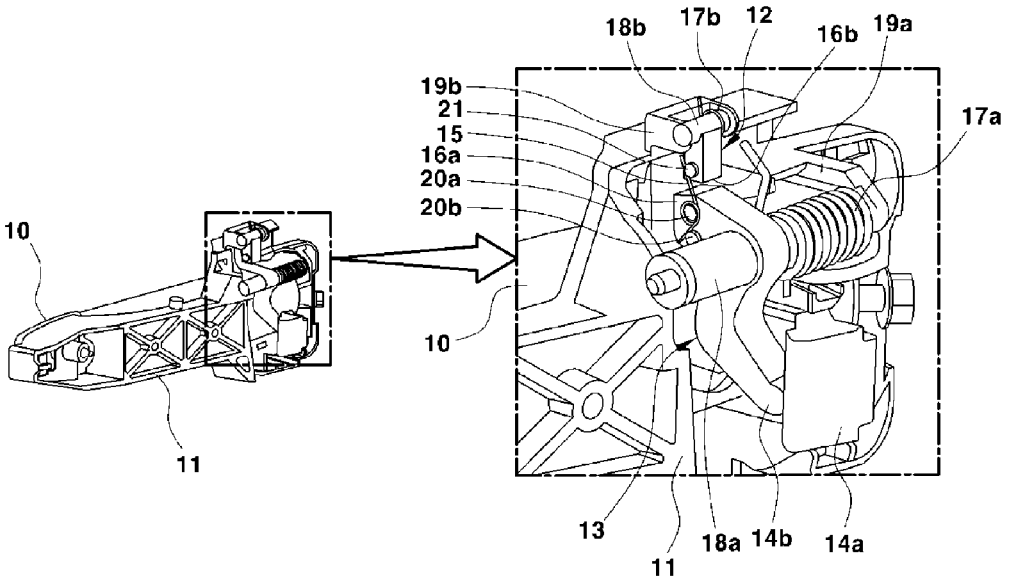
FIG. 1 is a perspective and magnified view illustrating an outside handle according to an exemplary embodiment of the present invention.
Figure 2A:
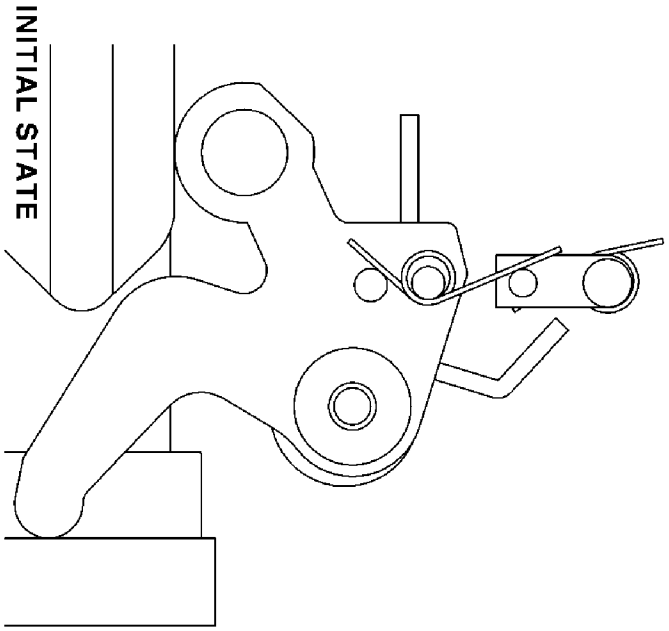
FIGS. 2A to 2E are side views illustrating a normal operation state of an outside handle according to an exemplary embodiment of the present invention.
Figure 2B:
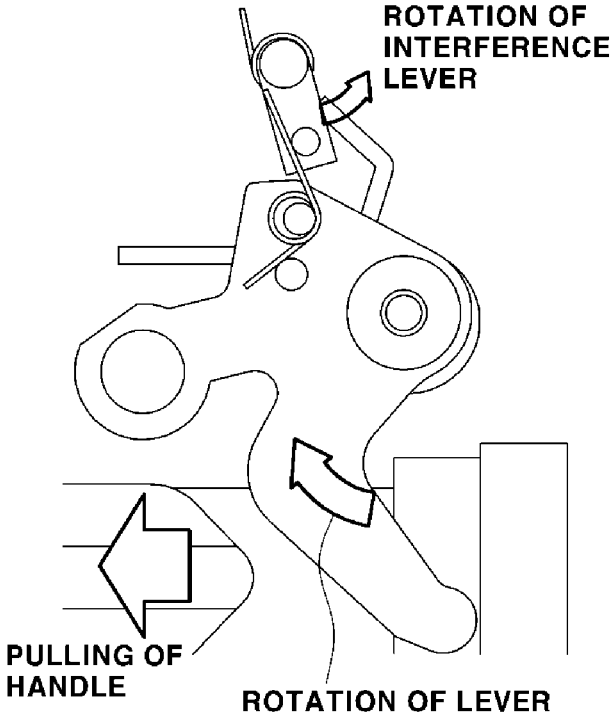
Figure 2C:
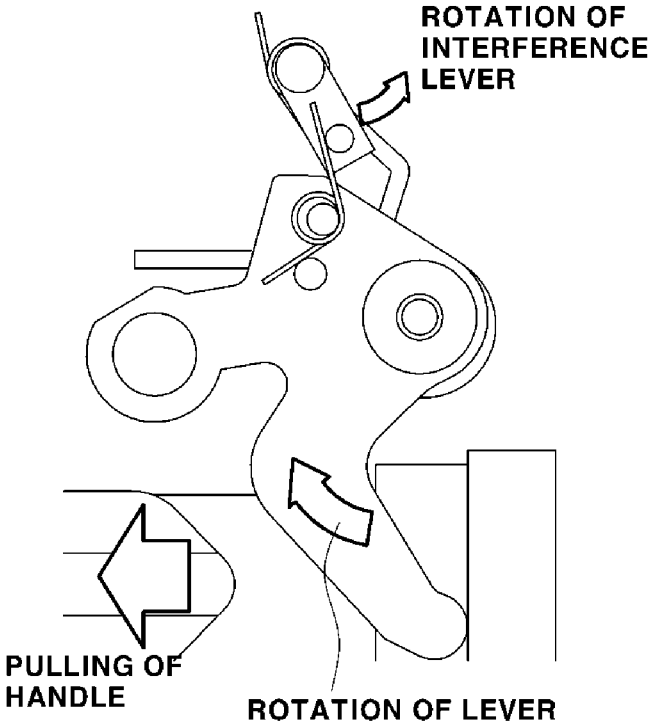
Figure 2D:
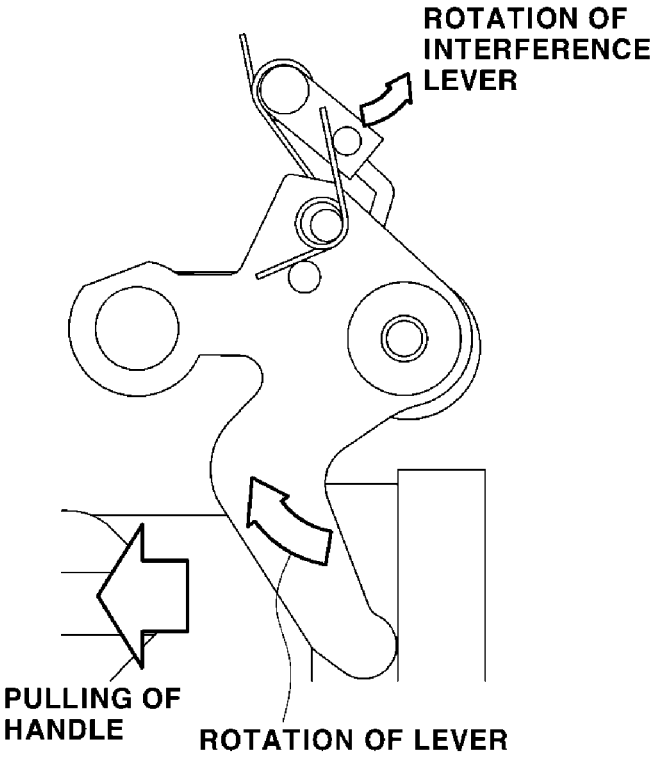
Figure 2E:
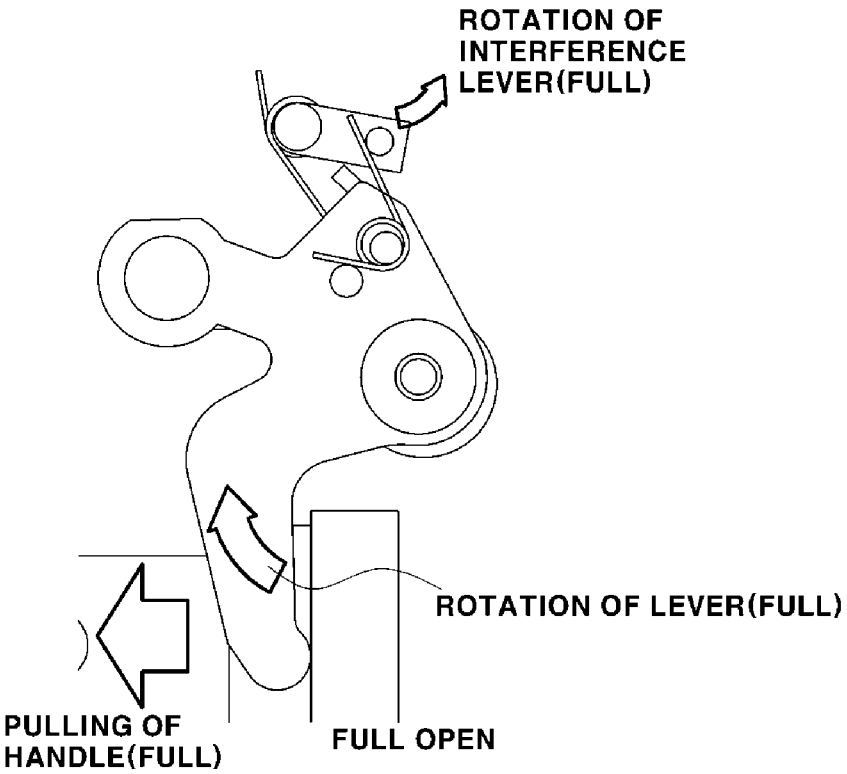

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g., fuels derived from resources other than petroleum). As referred to herein, a hybrid vehicle is a vehicle that has two or more sources of power, for example both gasoline-powered and electric-powered vehicles.

The above and other features of the invention are discussed infra.

Hereinafter, exemplary embodiments of the present invention will be described in detail with reference to the accompanying drawings so that those skilled in the art can easily carry out the present invention.

FIG. 1 shows perspective and magnified views illustrating an outside handle according to an exemplary embodiment of the present invention.

As shown in FIG. 1, the outside handle may include a structure that can effectively prevent the opening of a door, by offsetting an inertial force of the handle using a combination of a handle lever and an interference lever that interfere with each other upon side crash.

To this end, the outside handle may include a handle grip 10 disposed outside a door outer panel and a handle base 11 disposed inside the door outer panel.

The handle grip 10 is a part that a user directly manipulates. The handle grip 10 may include a locking part 14*a* disposed on the rear surface thereof and extending to the inside. The locking part 14*a* may be locked with a locking part 14*b* of the handle lever 13.

Thus, when handle grip 10 is pulled to open the door, a latch may be released to open the door. In this case, the handle lever 13 may also rotate together due to a locking action between the locking parts 14*a* and 14*b*.

Here, since the installation at the panel of the handle base 11 and the release of the latch upon manipulation of the handle grip 10 are similar to those in a related art, a detailed description thereof will be omitted.

Also, the handle lever 13 may be disposed to rotate in linkage with the pulling of the handle grip 10.

The handle lever 13 may include a lever body part including an interference part 16*b* at the upper end thereof and a locking part 14*b* at the lower end thereof, and a lever axis 18*a* that horizontally extends from both sides of the lever body part integrally with the lever body part.

The handle lever 13 may be supported by a lever installation part 19*a* disposed at one side of the handle base 11, i.e., a rear side of the handle base 11 on the basis of both ends of the lever axis 18*a* so that the handle lever 13 can rotate on the lever axis 18*a*.

The locking part 14*b* of the handle lever 13 may be disposed at the front side of the locking part 14*b* of the handle grip 10. Accordingly, when the handle grip 10 is pulled, the handle lever 13 may also rotate on the lever axis 18*a* due to the locking action between the locking parts 14*a* and 14*b*.

Also, the interference part 16*b* formed at the upper end of the handle lever 13 may be formed to have a flat surface. The interference part 16*b* may be locked with an interference part 16*a* disposed at the interference lever 12 described later and formed to have a flat surface when the handle lever 13 rapidly rotates. Thus, the rotation of the handle lever 13 may be restricted by the interlocking action between the interference parts 16*a* and 16*b*.

Also, a return spring 17*a* may be provided to the handle lever 13. The return spring 17*a* may include one end portion fixed to the handle base 11 and the other end portion fixed to the handle lever 13. The return spring 17*a* may be wound around the lever axis 18*a* several times.

Thus, when an external force is not applied, the handle lever 13 may return to the initial position, where the locking part 14*b* at the lower end of the handle lever 13 contacts the front surface of the locking part 14*a* of the handle grip 10, by an elastic restoring force exerted by the return spring.

Also, two spring fixing protrusions 20*a* and 20*b* may adjacently protrude from the upper side surface of the handle lever 13. The spring fixing protrusion 20*a* may be coupled to the central portion, e.g., a coiled portion of a connection spring 15 described later, and the spring fixing protrusion 20*b* may support one end portion of the connection spring 15.

Particularly, the interference lever 12 may be provided to prevent the pulling of the handle grip 10 by substantially controlling the handle lever 13 upon side crash.

The interference lever 12 may include a lever body part having a rod shape and a lever axis 18*b* disposed at the upper end of the lever body part and formed integrally with the lever body part. The lower end of the lever body part may be an interference part 16*a* with a flat surface, which can control the rotation of the hand lever 13 while interlocking with the interference part 16*b* of the handle lever 13.

The interference lever 12 may be located over the handle lever 13 and may be supported by a lever installation part 19*b* disposed at an upper end portion of the handle base 11 on the basis of both end portions of the lever axis 18*b* so that the interference lever 12 can rotate on the lever axis 18*b*.

Here, the lever axis 18*b* of the interference lever 12 and the lever axis 18*a* of the handle lever 13 may be disposed side by side along a horizontal direction of the outside handle, and simultaneously, the lever body part of the interference lever 12 and the lever body part of the handle lever 13 may be aligned with each other in a vertical direction.

Thus, the handle lever 13 and the interference lever 12 may operate in linkage with each other, or may stop rotating together.

The interference part 16*a* of the interference lever 12 may be located just over the interference part 16*b* of the handle lever 13, and thus, when the handle lever 13 rapidly rotates, the rotation of the handle lever 13 can be controlled by the interlocking action between the interference parts 16*a* and 16*b*.

Also, the interference part 16*a* formed at the lower end of the interference lever 12 may be formed to have a flat surface. The interference part 16*a* may be locked with the interference part 16*b* disposed at the handle lever 13 and also formed to have a flat surface when the handle lever 13 rapidly rotates. Thus, the rotation of the handle lever 13 may be restricted by the interlocking action between the interference parts 16*b* and 16*a*.

Also, a return spring 17*b* may be provided to the interference lever 12. The return spring 17*a* may include one end portion fixed to the handle base 11, i.e., the lever installation part 19*b* formed in the handle base 11 and the other end portion fixed to the interference lever 12. The return spring 17*a* may be wound around the lever axis 18*b* several times.

Thus, when an external force is not applied, the interference lever 12 may return to the initial position, where the interference part 16*a* at the lower end of the interference lever 12 faces the bottom while the interference lever 12 becomes upright, by an elastic restoring force exerted by the return spring 17*b*.

Also, a spring locking protrusion 21 may protrude from the side surface of the interference lever 12. In this case, one end portion of the connection spring 15 fixed to the handle lever 13 may be locked and supported by the spring locking protrusion 21.

The connection spring 15 may be provided to intervene between the handle lever 13 and the interference lever 12.

The coiled central portion of the connection spring 15 may be fixedly disposed at the spring fixing protrusion 20*a* of the handle lever 13. One end portion of the connection spring 15 may be locked on the spring fixing protrusion 20*a* of the handle lever 13, and the other end portion thereof may be locked on the spring locking protrusion 21 of the interference lever 12.

Thus, when the handle lever 13 rotates, the interference lever 12 may together rotate via the connection spring 15.

Hereinafter, the operation state of the outside handle will be described in detail.

FIGS. 2A to 2E are side views illustrating a normal operation state of an outside handle according to an exemplary embodiment of the present invention.

As shown in FIGS. 2A to 2E, when the handle grip 10 is pulled at ordinary times, the handle lever 13 may clockwise rotate due to the interlocking action between the locking parts 14*a* and 14*b*, and simultaneously, the interference lever 12 may be together operated by a force of the connection spring 15 connecting between the handle lever 13 and the interference lever 12 while counterclockwise rotating.

In this case, the torque of the handle lever 13 may be delivered to the connection spring 15, and thus the interference lever 12 may rotate due to the force of the connection spring 15. That is, the connection spring 15 may rotate in advance the interference lever 12 before the interference part 16*b* of the handle lever 13 reaches the interference part 16*a* of the interference lever 12, allowing the interference lever 12 to be avoided. Thus, an interference between the interference part 16*b* of the handle lever 13 and the interference part 16*a* of the interference lever 12 may not occur.

As a result, when the handle grip is pulled at ordinary operation, the handle lever, the connection spring, and the interference lever may not be interfered with each other, thereby allowing the door to be normally opened.

Figure 3A:
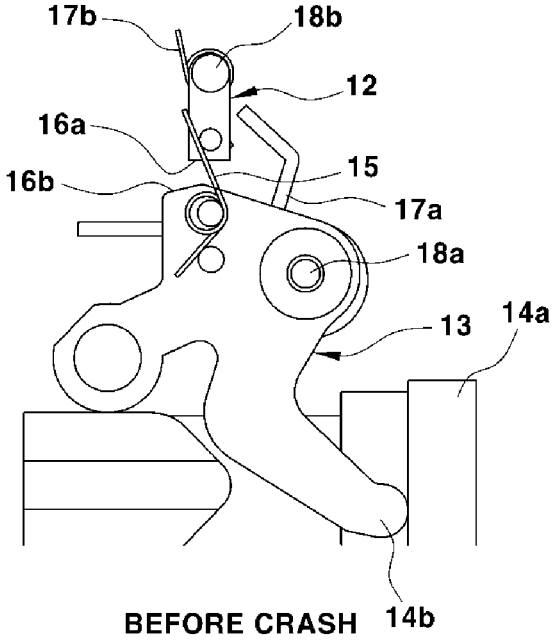
FIGS. 3A to 3C are side views illustrating a crash operation state of an outside handle according to an exemplary embodiment of the present invention.
Figure 3B:
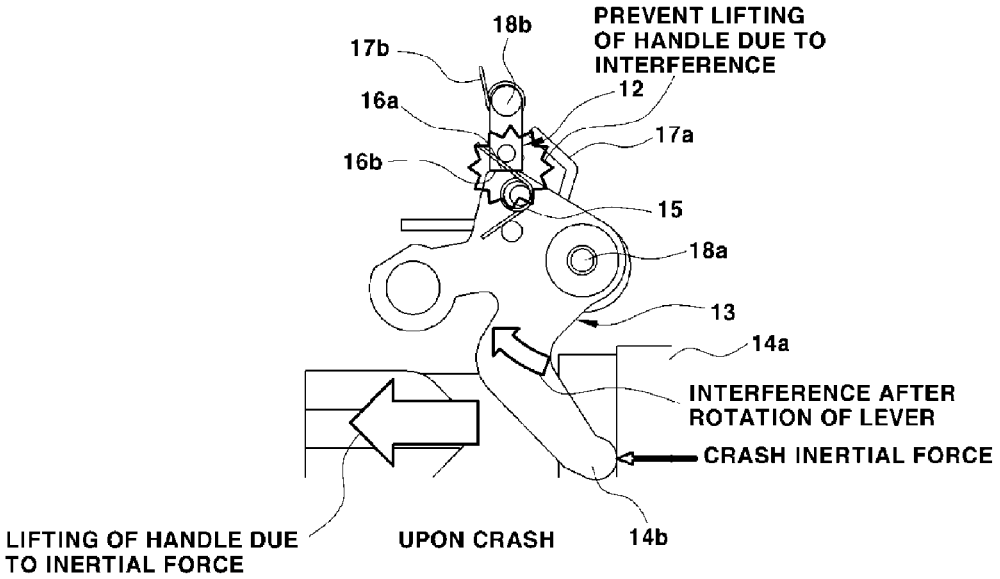
Figure 3C:
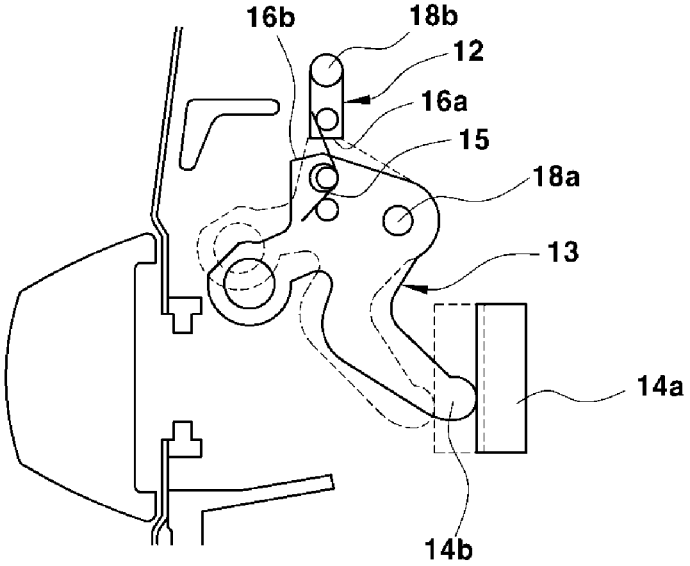
Figure 4:
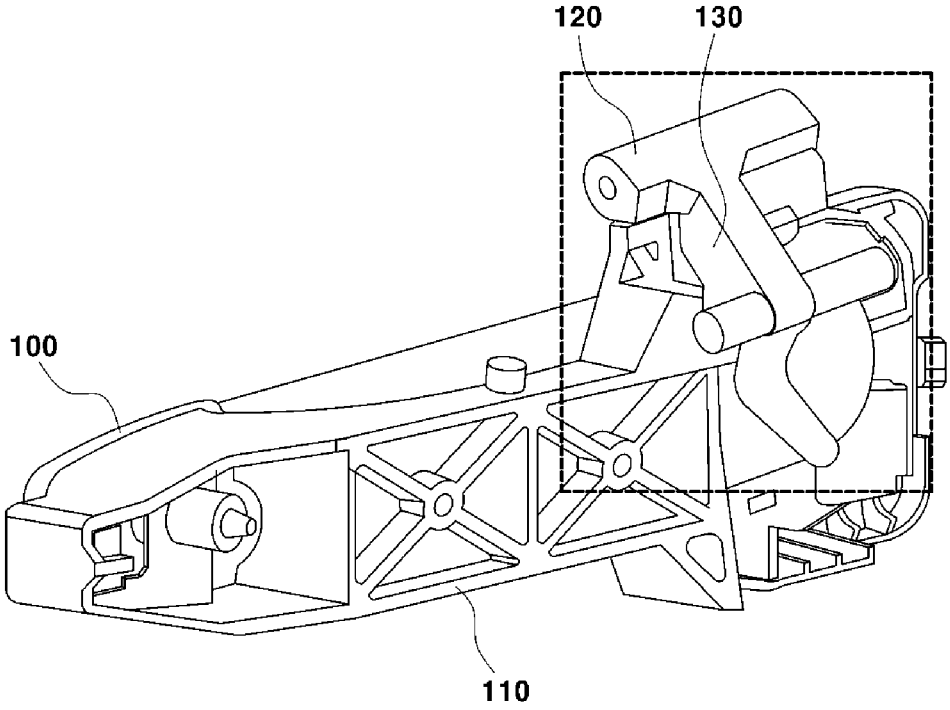
FIG. 4 (Related Art)
FIG. 4 is a perspective view illustrating a typical outside handle.
Figure 5:
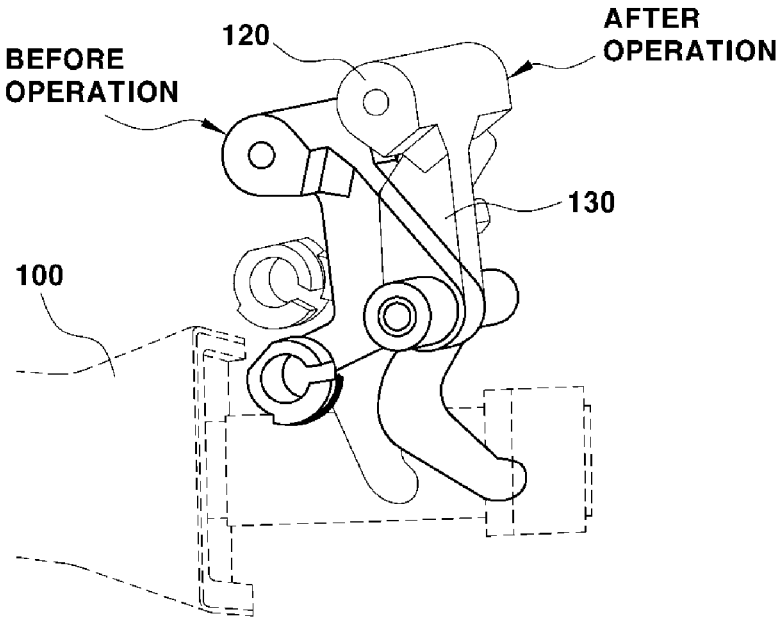
FIG. 5 (Related Art)
FIG. 5 is a perspective view illustrating an operation state of a typical outside handle.

FIGS. 3A to 3C are side views illustrating a crash operation state of an outside handle according to an exemplary embodiment of the present invention.

As shown in FIGS. 3A to 3C, upon side crash of a vehicle, the outside handle, i.e., the handle grip 10 may be pulled to the outside by an inertial force, and simultaneously, the handle lever 13 may also be instantaneously rotated by the locking action between the locking parts 14*a* and 14*b*.

Thus, the handle lever 13 may also be rapidly rotate by the instantaneous pulling of the handle grip 10 due to the inertial force upon side crash, and before the connection spring 15 that delivers the torque of the handle lever 13 to the interference lever 12 rotates the interference lever 12, the interference part 16*b* of the handle lever 13 may contact and interlock with the interference part 16*a* of the interference lever 12 that stands upright.

That is, since the flat surface of the handle lever and the flat surface of the interference lever contact each other in a horizontal state and an interference occurs in a rotation direction of the handle lever, the rotation of the handle lever may be controlled, and the handle grip may not be further pulled, thereby preventing the door from being opened.

In case of side crash, since the inertial force generated in the outside handle rapidly increases to about 200 G, the handle lever may rotate before the connection spring at the side of the handle lever pushes the interference lever, and thus, an interference between the interference lever and the handle lever occurs, allowing the outside handle not to be pulled and thus preventing the door from being opened.

Accordingly, a typical balance weight can be omitted, and can be replaced with a combination of the handle lever and the interference lever. Thus, the inertial force of the outside handle can be maximally utilized, and thus the opening of the door can be effectively prevented in various situations of side crash of actual traffic accidents and passengers can be maximally protected.

An outside handle for a vehicle according to an exemplary embodiment of the present invention has the following advantages.

Recently, the size of the handle increases in terms of design, and the balance weight also increases to prevent the opening of the door.

In this case, the counter inertial force of the balance weight causes the possibility of opening of the door, and the weight of the balance weight inevitably increases.

Accordingly, since the outside handle structure according to the exemplary embodiment can deal with both normal inertial force and counter inertial force only with a small structure, the freedom degree of design may increase and the merchantability may be significantly improved. Also, the satisfaction of the side crash regulations (FMVSS 214 and SIMCAP in America) and the crash merchantability (IIHS, etc.) can be significantly improved.

Also, since only a very small structure can sufficiently deal with the inertia, the door opening can be prevented even in various crash modes including actual traffic accidents and regular tests.

Furthermore, the weight can be significantly reduced compared to a related art, and the implementation can be achieved without an additional cost.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. An outside handle apparatus for a vehicle, the outside handle apparatus comprising:

a handle grip including a first locking part;

a handle base;

a handle lever having a second locking part and rotatably supported by an axis of the handle lever at one side of the handle base and moving in linkage with the handle grip while the second locking part formed at an lower end of the handle lever is locked with the first locking part of the handle grip;

an interference lever pivotally coupled to the handle base at one side of the handle base; and a connection spring fixed to the handle lever and locked and supported by the interference lever at one extending end portion of the connection spring, wherein the interference lever is selectively moved by rotation of the extending end portion of the connection spring with the handle lever when the handle grip is pulled according to an external force applied to the handle grip.

2. The outside handle apparatus of claim 1, wherein the handle lever includes a first interference part with a flat surface at an upper end portion of the handle lever, and wherein the interference lever includes a second interference part with a flat surface at a lower end portion of the interference lever, and wherein the rotation of the handle lever is configured to be controlled by an interlocking interference between the first and second interference parts during the rotation of the handle lever upon the crash.

3. The outside handle apparatus of claim 1, wherein the handle lever includes a first return spring having a first end portion fixed to the handle base and a second end portion fixed to the handle lever to provide a restoring force to the handle lever.

4. The outside handle apparatus of claim 1, wherein the interference lever includes a second return spring having a first end portion fixed to the handle base and a second end portion fixed to the interference lever to provide a restoring force to the interference lever.

5. The outside handle apparatus of claim 1, wherein the return spring is configured to bias the first interference part of the interference lever toward the second interference part of the handle lever.

* * * * *